United States Patent [19]

Haeussler et al.

[11] Patent Number: 5,065,797

[45] Date of Patent: Nov. 19, 1991

[54] GRIPPER HEAD FOR SHUTTLELESS LOOMS

[75] Inventors: Horst Haeussler, Lindau; Hubert Ortmann, Hergatz; Harald Stoerr, Lindau, all of Fed. Rep. of Germany

[73] Assignee: Lindauer Dornier Gesellschaft m.b.H., Lindau, Fed. Rep. of Germany

[21] Appl. No.: 552,820

[22] Filed: Jul. 13, 1990

[30] Foreign Application Priority Data

Jul. 15, 1989 [DE] Fed. Rep. of Germany ..... 3923540

[51] Int. Cl.[5] ..... D03D 47/20

[52] U.S. Cl. ..... 139/448; 139/196.2; 24/564

[58] Field of Search ..... 139/246, 453, 196.2, 139/448; 112/253, 254; 74/594.6; 24/564, 556, 561

[56] References Cited

U.S. PATENT DOCUMENTS

| | | | |
|---|---|---|---|
| 2,923,325 | 2/1960 | Dewas | 139/448 |
| 3,519,028 | 7/1970 | Golobart | 139/448 X |
| 3,532,136 | 10/1970 | Golobart | 139/448 |
| 3,915,201 | 10/1975 | Mackie | 139/448 |
| 3,998,251 | 12/1976 | Hadam | 139/448 |
| 4,381,683 | 5/1983 | Takeda | 74/594.6 |
| 4,418,727 | 12/1983 | Santucci | 139/448 |
| 4,505,305 | 3/1985 | Pezzoli | 139/448 |
| 4,587,998 | 5/1986 | Egloff et al. | 139/448 |
| 4,736,778 | 4/1988 | Pezzoli | 139/448 |
| 4,903,623 | 2/1990 | Adamski et al. | 112/253 X |

FOREIGN PATENT DOCUMENTS

| | | | |
|---|---|---|---|
| 0115238 | 8/1984 | European Pat. Off. | 139/448 |
| 2278815 | 3/1976 | France | 139/448 |
| 2059455 | 4/1981 | United Kingdom | 139/448 |

*Primary Examiner*—Andrew M. Falik
*Attorney, Agent, or Firm*—W. G. Fasse

[57] ABSTRACT

A gripper head for a loom is of lightweight construction and has a weft thread clamp with a stationary pad and a movable pad. The former is directly mounted to the gripper body. The latter is mounted through an adjustable spring to the gripper body, whereby the clamping force is adjustable.

20 Claims, 2 Drawing Sheets

GRIPPER HEAD FOR SHUTTLELESS LOOMS

FIELD OF THE INVENTION

The invention relates to a gripper head for shuttleless looms, especially power looms in which two gripper heads are secured to respective gripper rods which move into and out of the loom shed for the insertion of the weft thread.

BACKGROUND INFORMATION

Such gripper heads are equipped with weft thread clamping means located near the forward gripper head tip. The clamping means usually comprise a fixed clamping pad cooperating with a lever operated movable clamping pad arranged opposite the fixed clamping pad.

In the known gripper head the movable clamping pad is secured to the free leading or forward end of the gripper head by means of a tiltable lever supported on the body of the gripper head. This tiltable lever is operatively connected with a control cam or lever which controls the opening and closing movement of the clamping mechanism, or rather, of the movable clamping pad of the clamping mechanism. The control cam or lever is mounted in the machine frame and operates the tilting lever, whereby the leading end of the weft thread can be gripped between the movable and stationary or fixed clamping pads at the tip of the gripper head. The tiltable lever is spring biased.

One problem with conventional gripper heads of this type resides in the fact that they have a relatively large mass causing respective high inertia forces when these gripper heads are used in looms, especially high speed looms. Such inertia forces limit the operational speed of the loom and also the useful life of the loom components, especially movable loom components because inertia forces increase the wear and tear.

The gripper heads are the last link, so to speak, in the entire drive chain. Therefore, the gripper heads influence the entire drive chain in accordance with the gripper head mass. As a result, all components in the drive chain must be dimensioned in accordance with the requirements dictated by the mass of the gripper heads. It is therefore desirable to make the gripper heads as light as possible, while still assuring their intended purpose. A light gripper head makes it possible to use lighter components throughout the drive chain. Thus, the gripper rod may be of lighter construction, which in turn permits a lighter drive wheel and so forth.

OBJECTS OF THE INVENTION

In view of the foregoing it is the aim of the invention to achieve the following objects singly or in combination:

to construct a gripper head for a high speed power loom in such a way that the gripper head mass is substantially reduced while still assuring the proper performance of the gripper head for the weft thread insertion into the loom shed;

to avoid a tilting lever altogether for the mounting of a movable clamping pad in the gripper head;

to mount a clamping pad for a gripper head on a spring itself, preferably in an adjustable manner;

to provide cut-outs in the body and other gripper head components for the reduction of its mass; and to reduce the clamping forces by using smaller clamping masses so that breaking of the weft thread due to the clamping action is reduced or altogether avoided.

SUMMARY OF THE INVENTION

According to the invention the present clamping head is characterized in that the movable clamping pad is mounted to the free end of a mounting spring which in turn is mounted with its other end to the body of the gripper head. The mounting of the spring to the gripper head body is preferably adjustable so that a desirable clamping force may be adjusted. The construction according to the invention for the mounting of the movable clamping pad by means of a spring avoids the use of a tiltable separate pad carrying clamping lever, whereby the mass of the entire head is reduced. This feature saves about 50 grams. It has been found that such a mass reduction results in a substantially reduced wear and tear, especially at high operational speeds. This wear and tear reduction applies not only to the gripper head itself, but to all components, especially in the drive train.

As a result, the gripper head construction itself may be simplified and the costs can be reduced, for example, the gripper head can be made of lightweight sheet metal and a further weight reduction can be achieved by providing the gripper head elements with cut-outs. The overall weight or mass reduction also results in smaller clamping forces caused by smaller clamping masses so that tearing of the weft thread is further reduced.

By avoiding the use of a tilting lever altogether, fewer structural components are required, including fewer mounting positions so that wear and tear is further reduced.

According to a preferred embodiment of the invention the mounting spring is a straight or curved bending spring which carries at its forward free end, as viewed in the gripper thread insertion direction, a movable clamping pad. However, the mounting of the movable clamping pad is not limited to a bending spring. Rather, any known type of spring arrangement can be used for the present purposes. For example, so-called leg or leaf springs or torsion springs, or helical compression springs, could be used for the present purposes. The axial orientation of the respective spring relative to the gripper head body will depend on the type of spring used. With regard to the bending spring, for example, in the form of a leaf spring, it should be noted that a single leaf spring could be used, or a plurality of such leaf springs may be formed into a spring package.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
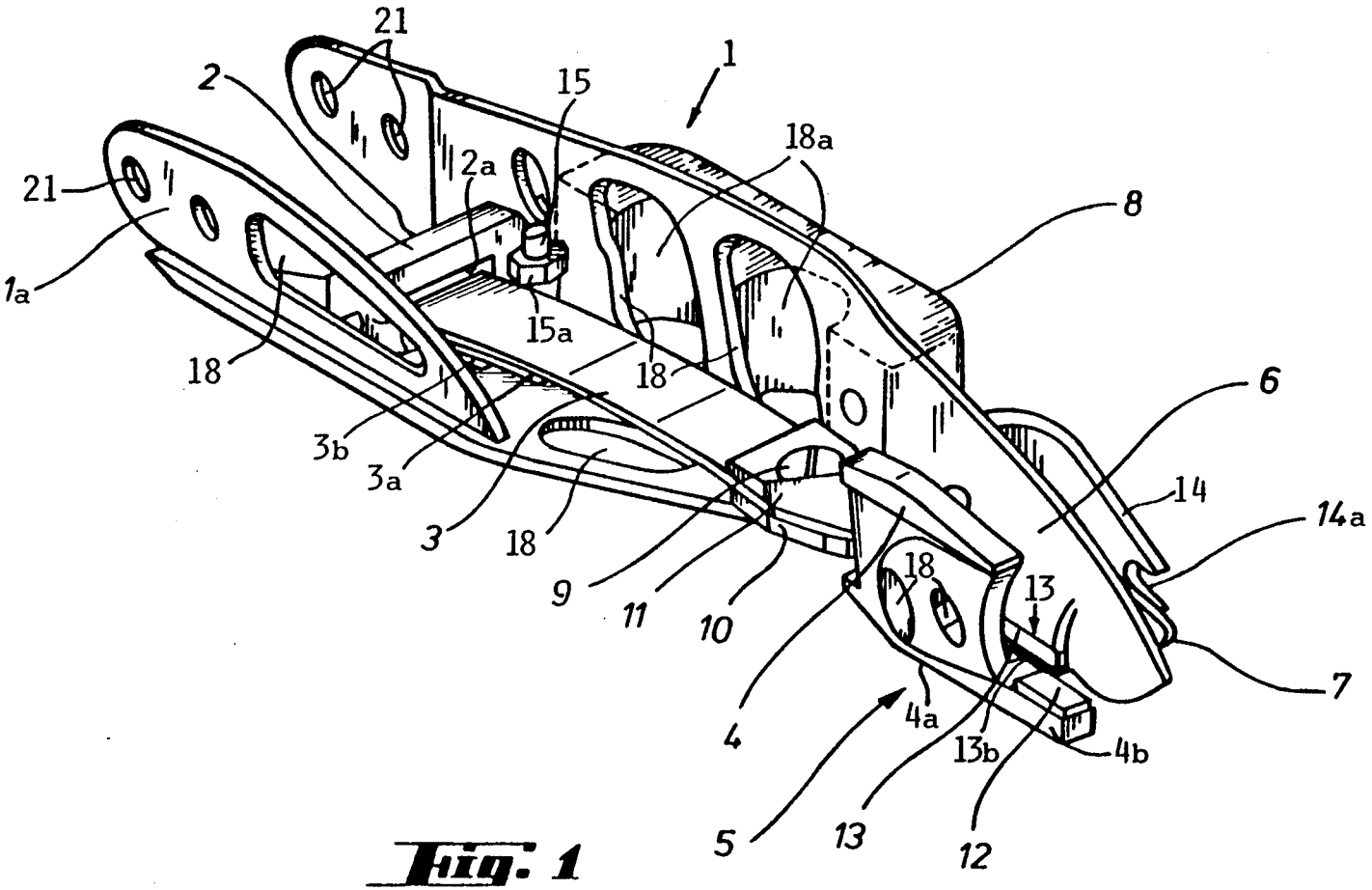
FIG. 1 shows a perspective view of a gripper head constructed as a weft thread insertion gripper.

The weft thread insertion gripper 1 shown in FIG. 1 in a perspective view comprises a gripper body 1*a* which is, for example, made of sheet metal. A spring bearing or support in the form of a mounting block 2 is adjustably secured to the body 1*a*. A spring 3 forming part of a leaf spring package with additional, shorter leaf springs 3*a* and 3*b*, is rigidly mounted in a slot 2*a* of the mounting block 2. Thus, the right-hand end of the leaf spring 3 is free for the mounting of a movable clamping pad 12, as will be described in more detail below.

The mounting block 2 is tiltable about a horizontal axis extending perpendicularly to the longitudinal axis of the gripper head 1. The means for adjusting the position of the mounting block 2 and thus the effectiveness or clamping force of the spring 3, is accomplished by adjusting means 15, 15*a* to be described in more detail with reference to FIG. 2 below.

A clamping block 5 having an upper guide skid 4 and a lower guide skid 4*a* is secured to the free end of the spring 3 by means of a first mounting arm 11, a counterpart 10, and a screw 9. The mounting arm 11 is rigidly secured to the back side of the mounting block 5. The counterpart 10 is provided with a threaded hole engaged by the threading of the screw 9 which passes through the mounting arm 11, through a hole in the free end of the spring 3, and through the counterpart 10. The skids 4 and 4*a* are guided on respective guide rails in the loom not shown. The guide skids 4 and 4*a* are made of a highly wear resistant material and are, for example, soldered or otherwise bonded to the clamp mounting block 5. Cut-outs or holes 18 are cut or provided in the clamp mounting block 5. Similar cut-outs 18 are provided in the gripper head body as shown in both FIGS. 1 and 2.

The lower skid 4*a* of the clamp mounting block 5 has an extension 4*b* carrying a movable clamping pad 12 which may have a wear resistant coating on its outer clamping surface as will be described in more detail below with reference to the stationary mounting pad 13. One or both pads may be so constructed.

The gripper body la has a forward extension called an anvil 6 which carries a further clamping pad 13 which is stationary relative to the first mentioned clamping pad 12, but moves with the gripper head back and forth. The stationary clamping pad 13 has an inner layer 13*a*, for example, made of an elastic resilient material covered with a highly wear resistant surface layer 13*b* of materials which are conventionally suitable for this purpose.

The portion of the gripper head body forming the anvil 6 carries a thread guide 14 provided with a forwardly open thread guide eyelet 14*a*. A movable cover element 7 closes the eyelet 14*a* in a lateral direction during certain operational states of the gripper as is conventional. This thread guide with its forwardly open eyelet is provided only for the insertion gripper head, but not for the withdrawal gripper head.

The gripper head further carries a lateral gripper guide piece 8 provided with cut-outs 18*a* for further weight reduction. Preferably, these cut-outs 18*a* register with cut-outs 18 in the lateral wall of the gripper body 1*a*.

Figure 2:
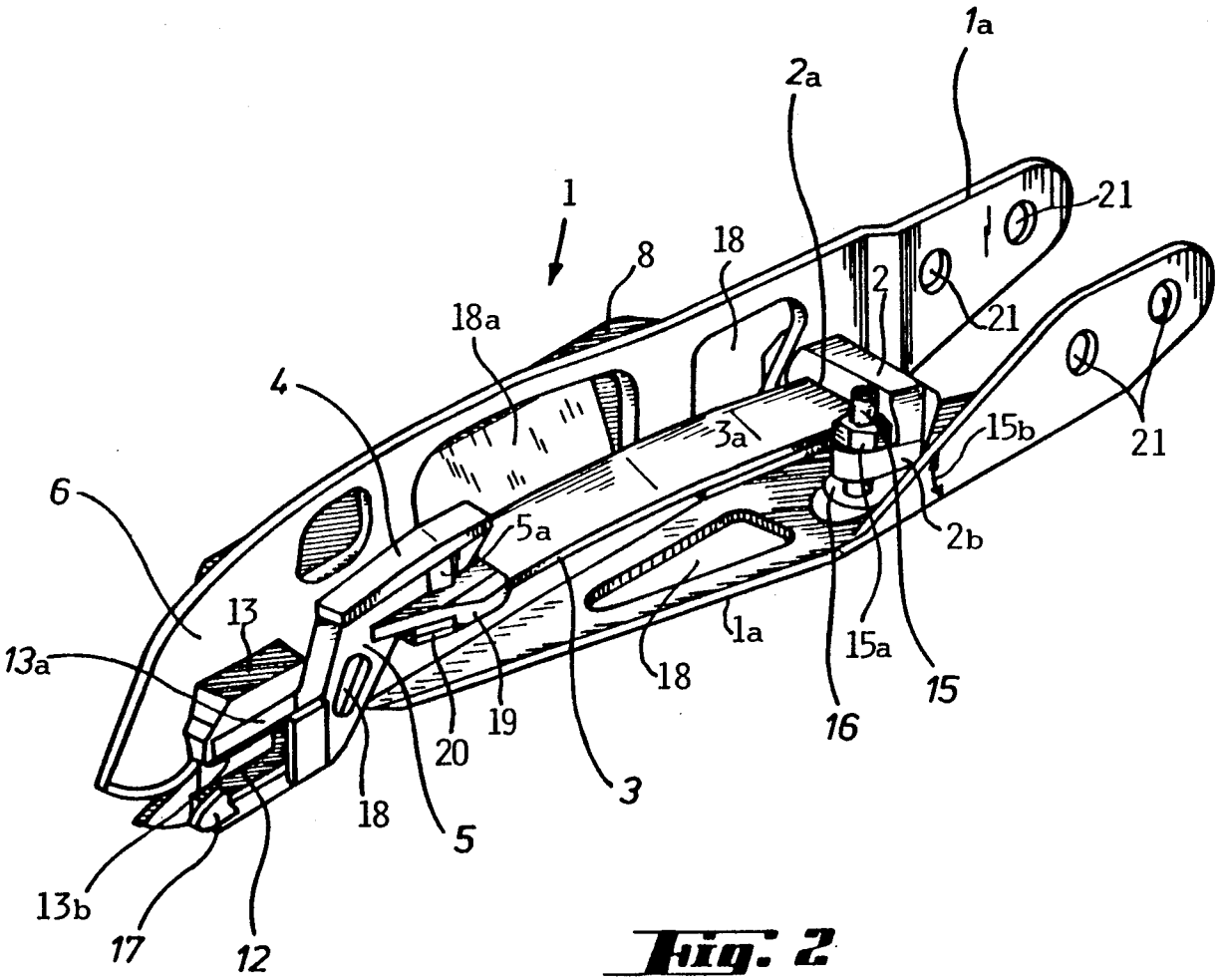
FIG. 2 is a perspective view similar to that of FIG. 1, however, showing the gripper head in its construction as a weft thread withdrawal head.

FIG. 2 illustrating a withdrawing gripper head according to the invention, is provided with the same reference numbers for the same elements. Therefore, a repetitious description is avoided to the extent possible.

FIG. 2 shows more clearly than FIG. 1 the spring force adjustment means including an arm 2*b* rigidly attached to the spring mounting block 2 and having a threaded hole through which a threaded bolt 15 extends. The lower free end of the bolt 15 bears against a fixed point 16 on the floor of the gripper body 1*a*. A counternut 15*a* secures the threaded bolt 15 in an adjusted position when the nut 15 bears against the extension arm 2*b*. When the nut 15 is loosened, the mounting block 2 for the spring 3 can be adjusted as indicated by the double arrow 15*b*.

The mounting block 5 for the movable clamping pad 12 is equipped with a thread deflector 17. The stationary mounting pad 13 which may be secured to the anvil 6 or which may be an integral part thereof, is equipped with an elastic intermediate portion 13*a* and with a wear resistant outer layer 13*b*. The rear portion of the clamp mounting block 5 is equipped with a mounting arm 19 in which the free end of the spring 3 is received in a laterally and axially confined manner. A clamping washer 20 has a hole through which a screw passes. The screw is not visibile, but extends through the mounting arm 19 into the block extension 5*a*.

Incidentally, each gripper body is also equipped with mounting holes 21 as shown in FIGS. 1 and 2.

Preferably, the springs in both types of gripper heads are so adjusted that the movable clamping pad and the stationary clamping pad extend with their surfaces facing each other in parallel to each other in the clamp closed position. Instead of mounting the movable pad on a leaf spring as described above, a torsion spring or a helical compression spring could be used for mounting the movable pad.

Although the invention has been described with reference to specific example embodiments, it will be appreciated that it is intended to cover all modifications and equivalents within the scope of the appended claims.

What is claimed is:

1. A gripper head for a shuttleless loom, comprising a gripper body, clamping means carried by said gripper body for gripping a weft thread, said clamping means comprising a stationary clamping pad and a movable clamping pad arranged for cooperation with said stationary clamping pad for gripping said weft thread, spring means for tiltably holding said movable clamping pad at a free end of said spring means near a forward end of said gripper body, means for mounting said spring means to said gripper body at another end of said spring means, and wherein at least one of said stationary and movable clamping pads comprises a two layer structure including a vibration damping layer and a wear resistant outer layer.

2. The gripper head of claim 1, wherein said spring means for holding said movable clamping pad comprises a bending spring, and wherein said spring mounting means hold said other end of said bending spring while said movable clamping pad is carried on said free end of said bending spring, said spring means permitting such a movement of said movable clamping pad that both pads extend in parallel to each other in a clamp closed position.

3. The gripper head of claim 1, wherein said clamping means comprise a clamp mounting block (5) secured to said spring means and having at least one gliding guide skid (4, 4*a*) for moving said movable clamping pad in response to movement of said gripper head.

4. The gripper head of claim 1, wherein said stationary clamping pad is constructed as an integral part of said gripper body.

5. The gripper head of claim 1, further comprising an anvil rigidly secured to said gripper body, said anvil forming a gripper tip having a forwardly open weft thread guide eyelet, said stationary clamping pad being arranged on said anvil near said gripper tip.

6. The gripper head of claim 1, wherein said spring means for holding said movable clamping pad comprises a leg or leaf spring carrying at its free leg end said movable clamping pad, said spring mounting means holding said other end of said leg or leaf spring.

7. The gripper head of claim 1, wherein said spring means for tiltably holding said movable clamping pad are mounted to said gripper body by said mounting means so that said spring means extends substantially perpendicularly to a tilting axis of said movable clamping pad.

8. The gripper head of claim 1, further comprising lateral guide means (8) secured to said gripper body for guiding a gripper movement.

9. The gripper head of claim 1, further comprising a plurality of cut-outs (18) in said gripper body for reducing the weight of said gripper body.

10. The gripper head of claim 1, further comprising adjustment means interposed between said spring mounting means and said gripper body for adjusting a position of said spring means in said gripper head and for adjusting a clamping pressure and pad position.

11. The gripper head of claim 10, wherein said adjustment means comprise a tilting arm (**2*b*) rigidly secured to said spring mounting means (2), a threaded member (15**) extending through a threaded hole in said tilting arm and bearing against a fixed point on said gripper body, and a counter nut on said threaded member bearing against said tilting arm for fixing an adjusted position.

12. The gripper head of claim 1, further comprising a clamp mounting block (5) for securing said movable clamping pad to a free end of said spring means.

13. A gripper head for a shuttleless loom, comprising a gripper body, clamping means carried by said gripper body for gripping a weft thread, said clamping means comprising a stationary clamping pad and a movable clamping pad arranged for cooperation with said stationary clamping pad for gripping said weft thread, spring means for tiltably holding said movable clamping pad at a free end of said spring means near a forward end of said gripper body, means for mounting said spring means to said gripper body at another end of said spring means, and wherein said mounting means for said spring means comprise adjustment means for adjustably securing said other end of said spring means to said gripper body, said adjustment means comprising a tilting arm (**2*b*) rigidly secured to said spring mounting means a threaded member (15**) extending through a threaded hole in said tilting arm and bearing against a fixed point on said gripper body, and a counter nut on said threaded member bearing against said tilting arm for fixing an adjusted position.

14. The gripper head of claim 13, further comprising a clamp mounting block (5) for securing said movable clamping pad to a free end of said spring means.

15. The gripper head of claim 13, wherein at least one of said stationary and movable clamping pads comprises a two layer structure including a vibration damping layer and a wear resistant outer layer.

16. The gripper head of claim 13, further comprising an anvil rigidly secured to said gripper body, said anvil forming a gripper tip having a forwardly open weft thread guide eyelet, said stationary clamping pad being arranged on said anvil near said gripper tip.

17. A shuttleless loom gripper head, comprising a gripper body, clamping means carried by said gripper body for gripping a weft thread, said clamping means comprising a stationary clamping pad (13) and a movable clamping pad (12) arranged for cooperation with said stationary clamping pad for gripping said weft thread, a bending leaf spring for tiltably holding said movable clamping pad, a clamp mounting block (5) securing said movable clamping pad to a free end of said bending leaf spring near a forward end of said gripper body, and position adjustable mounting means (2) for securing an adjustable end of said bending leaf spring to said gripper body so that a clamping pressure of said movable clamping pad is adjustable by adjusting the position of said adjustable end of said bending leaf spring relative to said gripper body.

18. The gripper head of claim 17, wherein at least one of said stationary and movable clamping pads comprises a two layer structure including a vibration damping layer and a wear resistant outer layer.

19. The gripper head of claim 17, further comprising a clamp mounting block (5) for securing said movable clamping pad to a free end of said spring means.

20. The gripper head of claim 19, wherein said mounting block comprises at least one gliding guide skid (4, **4*a***) for moving said movable clamping pad in response to movement of said gripper head.

* * * * *